US006024608A

United States Patent [19]

Azuma et al.

[11] Patent Number: 6,024,608

[45] Date of Patent: Feb. 15, 2000

[54] ELECTRICAL CONNECTOR WITH CONTACTS RETAINED IN HOUSING GROOVES

[75] Inventors: Yoichiro Azuma, Tokyo; Yasuhiro Ono, Kanagawa, both of Japan

[73] Assignee: Kel Corporation, Tokyo, Japan

[21] Appl. No.: 08/902,547

[22] Filed: Jul. 29, 1997

[30] Foreign Application Priority Data

Jul. 29, 1996 [JP] Japan ..... 8-198596

[51] Int. Cl.[7] ..... H01R 17/00

[52] U.S. Cl. ..... 439/660

[58] Field of Search ..... 439/733.1, 660, 439/346

[56] References Cited

U.S. PATENT DOCUMENTS 5,310,357 5/1994 Olson ..... 439/346

*Primary Examiner*—Neil Abrams
*Assistant Examiner*—Javaid Nasri
*Attorney, Agent, or Firm*—Robert W. J. Usher

[57] ABSTRACT

A contact 60 has a "T"-like cross section, in which the width W3 of a back face or back portion 61*d* is greater than the width W4 of a front face or main section 61*f*. A contact-retaining groove 54 has a trapezoidal cross section, in which the width W1 of a bottom of the contact-retaining groove is greater than the width W2 of an opening on a lateral face of a contact-retaining portion 52. Also, the width W2 of the opening of the contact-retaining groove is smaller than the width W3 of the back portion 61*d* of the contact. When the contact 60 is received and retained in the contact-retaining groove 54, at least the back portion 61*d* of the contact 60 is retained inside the contact-retaining groove 54.

9 Claims, 7 Drawing Sheets

ELECTRICAL CONNECTOR WITH CONTACTS RETAINED IN HOUSING GROOVES

FIELD OF THE INVENTION

The present invention generally relates to an electrical connector assembly of the type which has two intermatable, plug and receptacle connector halves, and more particularly to an electrical connector whose electrical contacts are securely retained in the housing.

BACKGROUND OF THE INVENTION

As connector of the above mentioned type, there is an electrical connector which comprises a plug connector and a receptacle connector, each a connector half, intermatable with each other for electrical connection. The plug connector includes a longitudinal row of plug contacts, each plug contact extending vertically in a plug-contact retaining portion of an electrically insulative housing. The receptacle connector includes a longitudinal row of receptacle contacts, each receptacle contact extending vertically in a receptacle-contact retaining portion of an electrically insulative housing.

In this electrical connector, either the plug contacts or the receptacle contacts are provided with resiliency for the purpose of maintaining a contact pressure necessary for each respective pair of plug and receptacle contacts to be held in electrical connection while the plug connector and the receptacle connector are intermated. In this case, usually the other group of contacts, i.e., plug contacts or receptacle contacts, which are not provided with resiliency are formed each in an ordinary plate and are retained each as is in the contact retaining portion of the respective housing.

However, these contacts which are applied in a plate form are inherently subjected to dimensional deviation in the fabrication process and inaccurate positioning in the assembly process. As a result, some of the contacts may be unintentionally positioned, extruding outward or being relieved out of the respective contact-retaining grooves of the contact-retaining portion. If the connector half assembled in such fault condition is mated with the other connector half, then such contacts in relief can be deformed. To avoid this problem of unintentional or accidental deformation, a design is proposed in which each of the contacts of a concerned connector half is provided with an engaging portion so that this engaging portion engages with a respective contact-retaining groove to keep the respective contact in a correct position without giving it any relief or extrusion.

As an example of such construction, each of the contacts 160 of a respective connector half is formed with a fattened "T" figure in cross section, and each corresponding contact-retaining groove 154 is formed likewise to receive this contact fittingly as shown in FIG. 10. In this design, however, it is difficult to provide a sufficient strength to extruding portions 155 which are formed at the opening of each of the contact-retaining grooves 154 for the purpose of withholding the pressurized insertion and of maintaining the pressurized retention of a respective contact 160. As a result, this design inherently has the problem of insufficient retainability of the contacts in the insulative housing.

FIG. 11 shows another design. Each of the contact-retaining grooves 254 is formed with a trapezoidal cross section, and each respective contact 260 is likewise formed with a trapezoidal cross section, correspondingly, so that the contacts 260 are press fit into the respective contact-retaining grooves 254, thereby being retained in the housing.

However, this design requires much quality control work in the production stage because it is difficult to maintain correct lengths for the upper and lower sides and correct angles for the slopes of the trapezoids, all of which factors are important for the contacts 260 to be press fit smoothly into and retained securely in the contact-retaining grooves 254. Thus, the difficulty involved in the fabrication of the contacts 260 and the grooves 254 makes this design infeasible.

SUMMARY OF THE INVENTION

The present invention was conceived to solve these problems. It is an object of the present invention to provide an electrical connector comprising contacts and contact-retaining grooves both of which are easily fabricated, yet in which the contacts are retained securely in the respective contact-retaining grooves.

In order to achieve this objective, the present invention provides a connector comprising a contact-retaining portion in an insulative housing for retaining a contact which extends in the direction of engagement with a matable connector (hereinafter referred to as "engagement direction"). On a lateral face of this contact-retaining portion, a contact-retaining groove is provided extending in the engagement direction for retaining the contact. This connector is engaged with the matable connector to establish an electrical connection of the contact which is retained in the contact-retaining portion with a matable contact which is provided in the matable connector.

This contact has at least at a tip portion a "T"-like cross section in a plane perpendicular to the engagement direction, and in this "T"-like cross section, the width of a back face of the contact is greater than the width of a front face thereof. Correspondingly, the contact-retaining groove has a trapezoidal cross section in a plane perpendicular to the engagement direction, and in this trapezoidal cross section, the width of a bottom of the contact-retaining groove is greater than the width of an opening thereof on the lateral face of the contact-retaining portion. Moreover, the width of the opening of the contact-retaining groove is smaller than the width of the back portion, i.e, the back face, of the contact so that at least the back portion of the contact is retained inside the contact-retaining groove when the contact is received and retained in the contact-retaining groove.

In this connector, the contact, which is to be retained in the contact-retaining groove, is correctly positioned in the assembly process so that the front face of the contact is exactly in the opening of the contact-retaining groove, being ready for an electrical connection with the matable contact. Furthermore, because the width of the back face of the contact at least at the tip portion thereof is greater than the width of the opening of the contact-retaining groove, it is impossible for the contact to be accidentally bent or distorted out of the contact-retaining groove.

It is preferable that the width of the front face of the contact be smaller than the width of the opening of the contact-retaining groove and the thickness of the contact be greater than the depth of the contact-retaining groove. With this design, when the contact is received and retained in the contact-retaining groove, the front face of the contact is relieved out of the lateral face of the contact-retaining portion. As a result, improvement is made for the security of establishing an electrical connection of the contact with the matable contact.

It is also preferable that the back face side of the contact be press fit into the contact-retaining groove for the contact to be received and retained in the contact-retaining groove. In this way, because the back face side of the contact, which has portions extended widthwise and formed with a smaller thickness than the thickness to the front face, is press fit into the contact-retaining groove, the press work which securely press fits the contact into the contact-retaining groove requires a relatively small force.

Furthermore, it is preferable that the "T"-like cross section of the contact be formed by press working both edges of the front portion thereof In this way, the "T"-like cross section is relatively simply and accurately achieved in the contact.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention and wherein.

DESCRIPTION OF THE PREFERRED EMBODIMENTS

Figure 1:
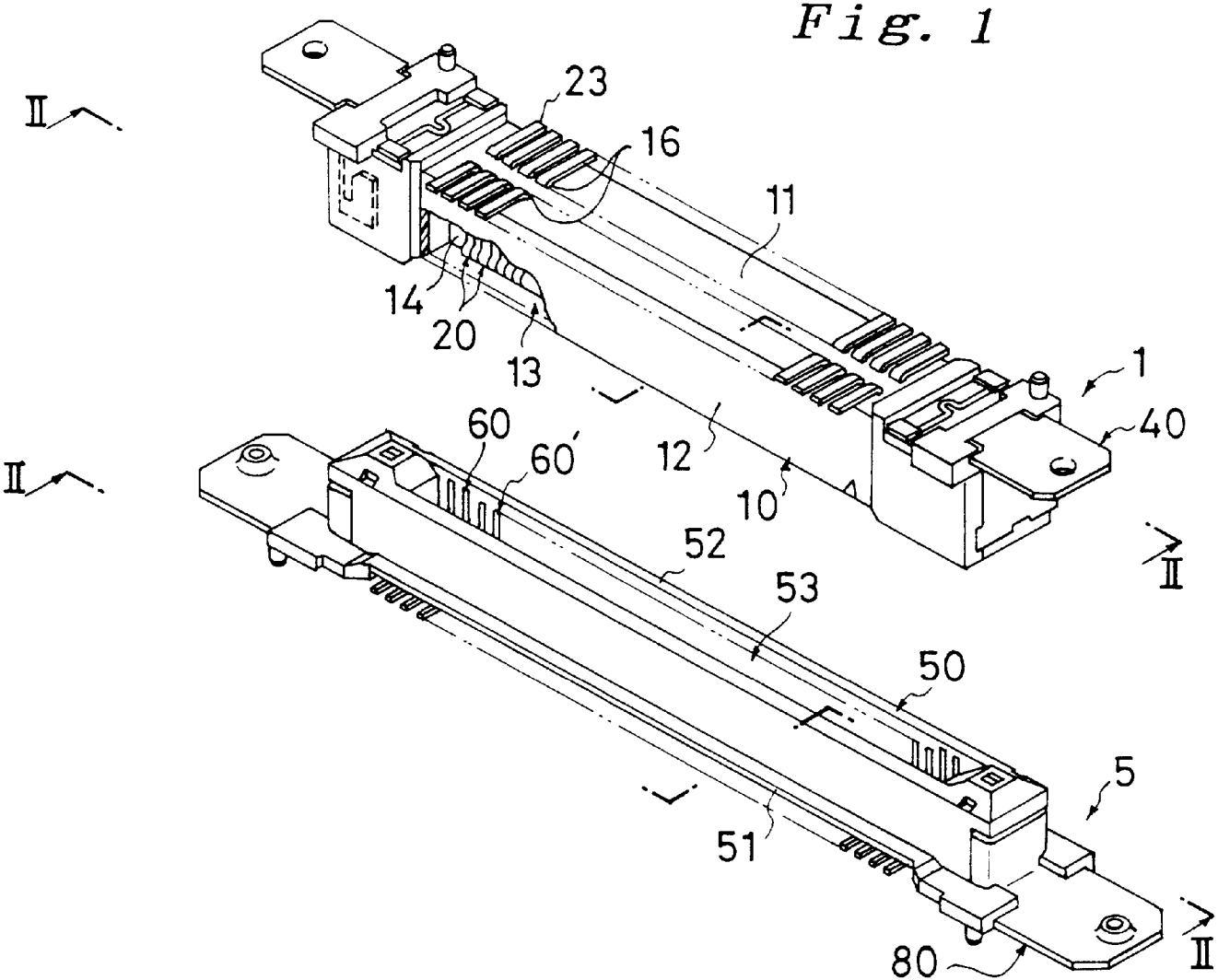
FIG. 1 shows a perspective view of receptacle and plug connectors of an electrical connector as a preferred embodiment of the present invention.
Figure 2:
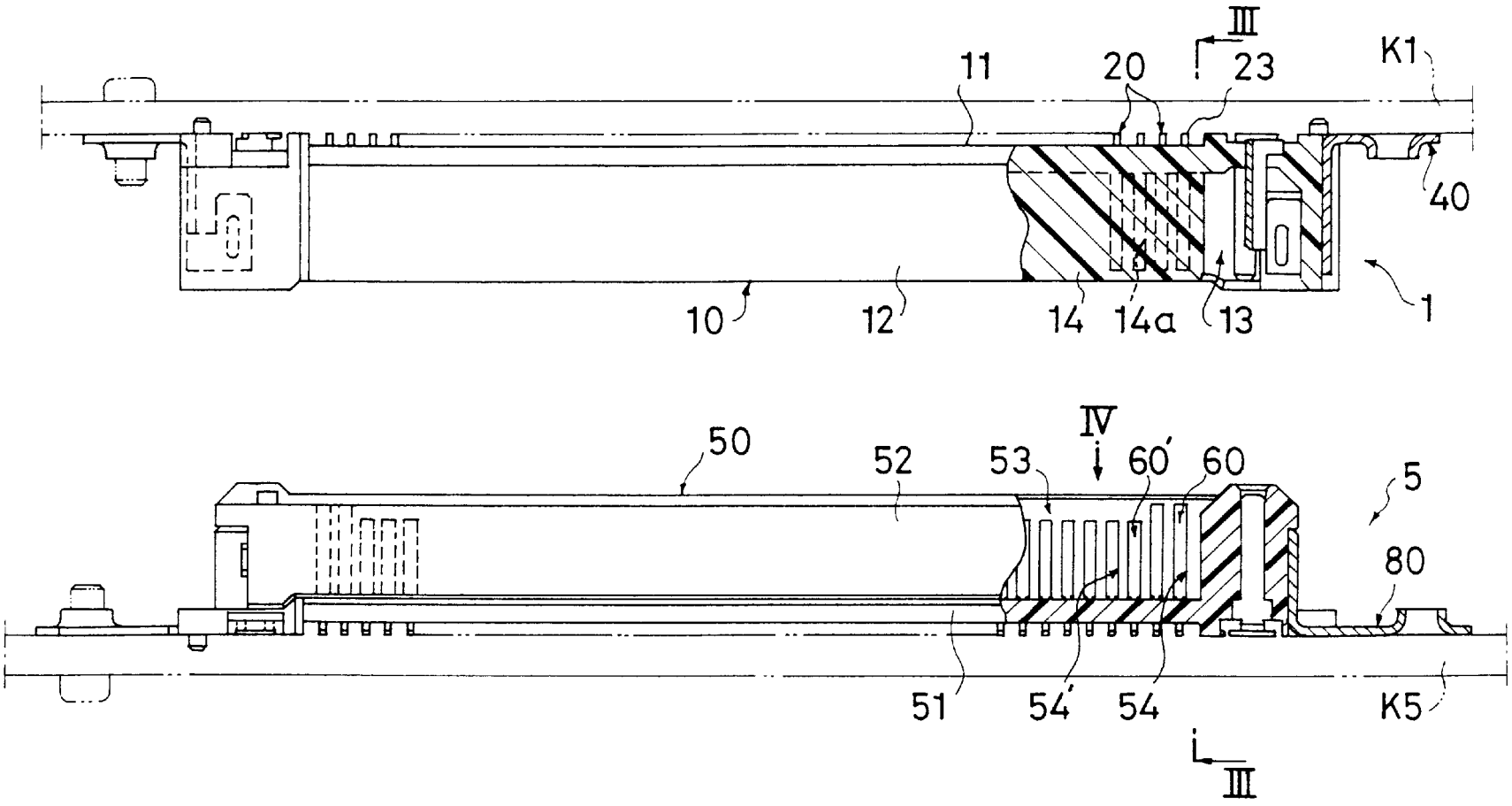
FIG. 2 shows a sectional view of the connector, taken along line II—II in FIG. 1.
Figure 3:
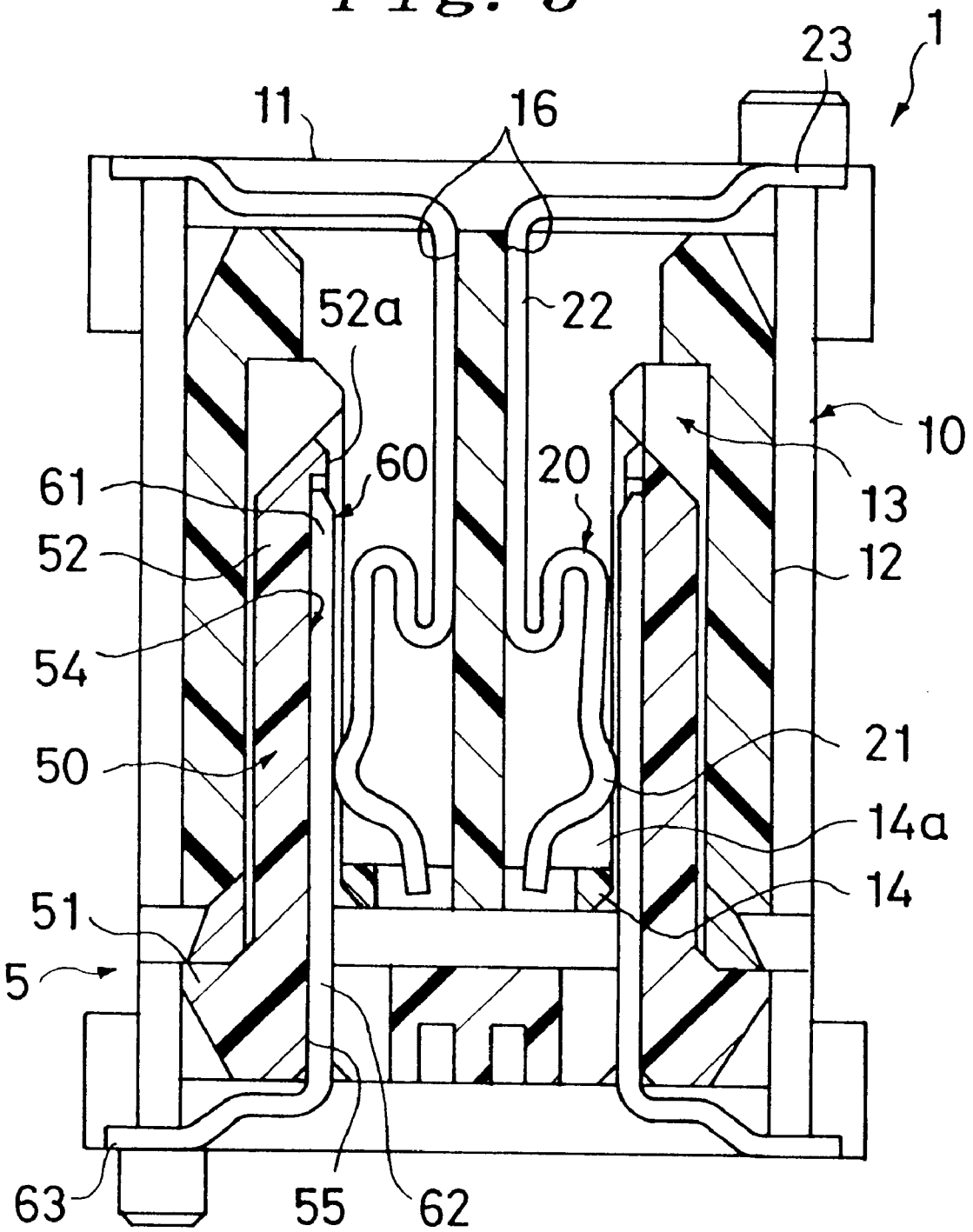
FIG. 3 shows a sectional view of the connector with the plug and receptacle connectors being intermated, taken along line III—III in FIG. 2.
Figure 4:
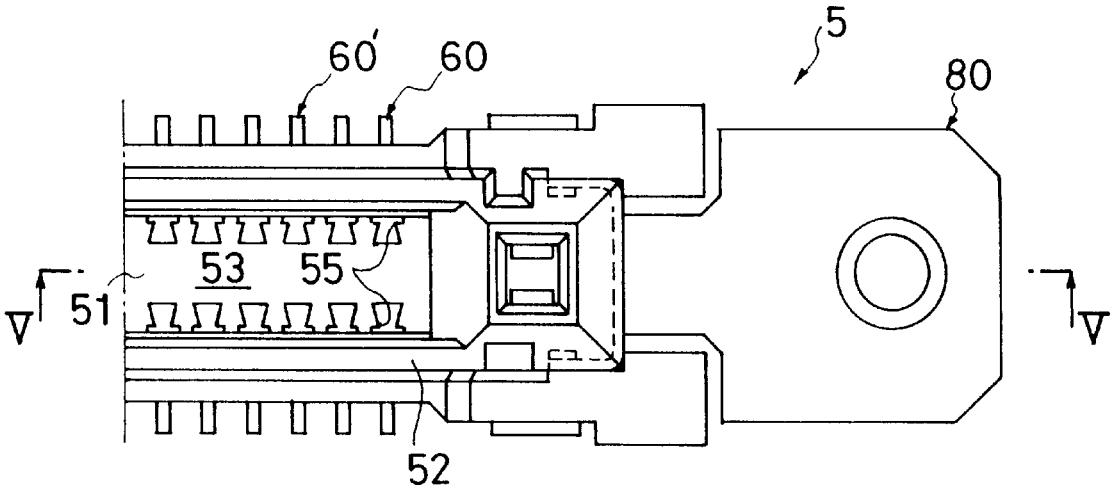
FIG. 4 shows an enlarged sectional view of the connector seen in IV direction in FIG. 2.
Figure 5:
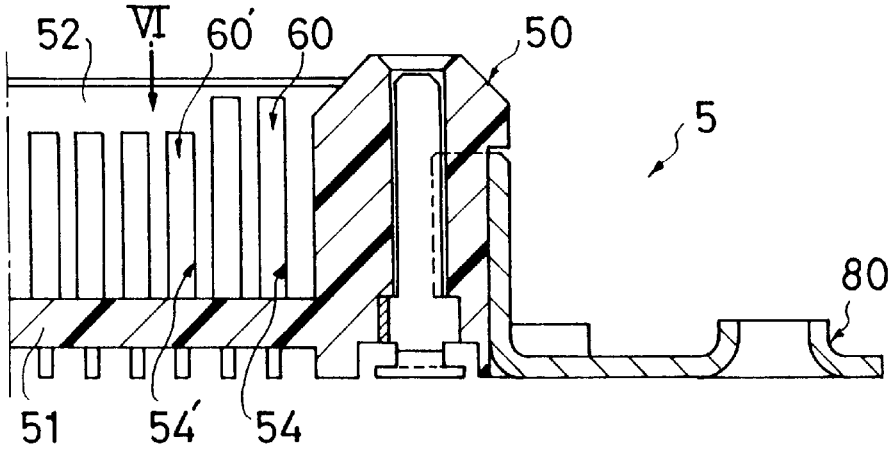
FIG. 5 shows a sectional view of the connector, taken along line V—V in FIG. 4.

An electrical connector according to the present invention comprises a plug connector half (hereinafter referred to as "plug connector") 1 and a receptacle connector half (hereinafter referred to as "receptacle connector") 5, which is matable with the plug connector 1, as shown in FIG. 1 to FIG. 5. FIGS. 1 and 2 show the condition of the connector halves 1 and 5 in separation, and FIG. 3 shows the condition where both connector halves are intermated and the contacts 20 of the plug connector are in contact with the contacts 60 of the receptacle connector.

The plug connector 1 comprises a plurality of plug contacts 20, which are retained in a housing 10 formed of an insulative material, as shown in the figures. The plug housing 10 is integrally formed as a one-piece body having a rectangular base portion 11, a rectangular outer wall portion 12 which extends downward therefrom, and a rectangular plug contact-retaining portion 14 which extends downward from the base portion 11 inside the outer wall portion 12. As such, on the base portion 11 downward, an annular plug outer cavity 13 is created opening downward between the outer wall portion 12 and the plug contact-retaining portion 14.

Two rows of longitudinally aligned apertures 16 are formed in the base portion 11, each aperture extending vertically, and each of the apertures 16 is provided with a plug contact 20 therein from the upper face of the housing. A plurality of vertically extending guide grooves 14*a* are formed on the lateral outer surfaces of the plug contact-retaining portion 14 at locations corresponding to the right and left rows of apertures 16, respectively (in the direction of engagement with the receptacle connector), whereby the lower portions of the plug contacts 20 stitched into the apertures 16 are guided and staked into the guide grooves 14*a*.

Each plug contact 20 is made of an electrically conductive material and includes a contact portion 21, which is guided by a corresponding guide groove 14*a* in the plug outer cavity 13, an anchoring portion 22, which is stitched into and retained in a corresponding aperture 16, and a lead portion 23, which extends horizontally outward from the anchoring portion 22 in an extended Z-like figure. Each contact portion 21 is provided with resiliency in an insertable shape with the main portion extending laterally outward and the lower end bending inward. As a result, the receptacle connector 5, which will be described in detail later, is easily matable with the plug connector.

This plug connector 1 is placed on a circuit board K1, and the upper ends of the lead portions 23 of the plug contacts 20 are soldered to the circuit board K1. Also, the plug connector 1 is fixed on the circuit board K1 with screws through fixing plates 40 which are provided at the longitudinal ends of the plug housing 10.

The receptacle connector 5 comprises a plurality of receptacle contacts 60 and 60' which are retained in a receptacle housing 50 formed of an electrically insulative material, as shown in the figures. The receptacle housing 50 is integrally formed as a one-piece body having a rectangular base portion 51 and a rectangular side-wall portion (contact-retaining portion) 52 which upstands therefrom, forming a receptacle cavity 53 which opens to an upper mating face.

Two longitudinally extending rows of apertures 55 are provided vertically through the base portion 51 in communication with the receptacle cavity 53. Each of the apertures 55 has a receptacle contact 60 or 60' stitched therein from the lower side of the housing. As shown in the FIG. 5, a plurality of contact-retaining grooves 54 and 54' are formed on the inner lateral surfaces of the side-wall portion 52, being aligned with the corresponding apertures 55. As a result, the upper portions of the receptacle contacts 60 and 60' staked into the apertures 55 are guided into and retained in the contact-retaining grooves 54 and 54'. Both contact-retaining grooves 54 and 54' have a horizontally identical cross section, but the upper portion 54*b*' of each contact-retaining groove 54', where the contact portion 61' of a receptacle contact 60' is staked and retained, is shorter than that of each contact-retaining groove 54. The contact portion 61' will be described in detail later.

Figure 9:
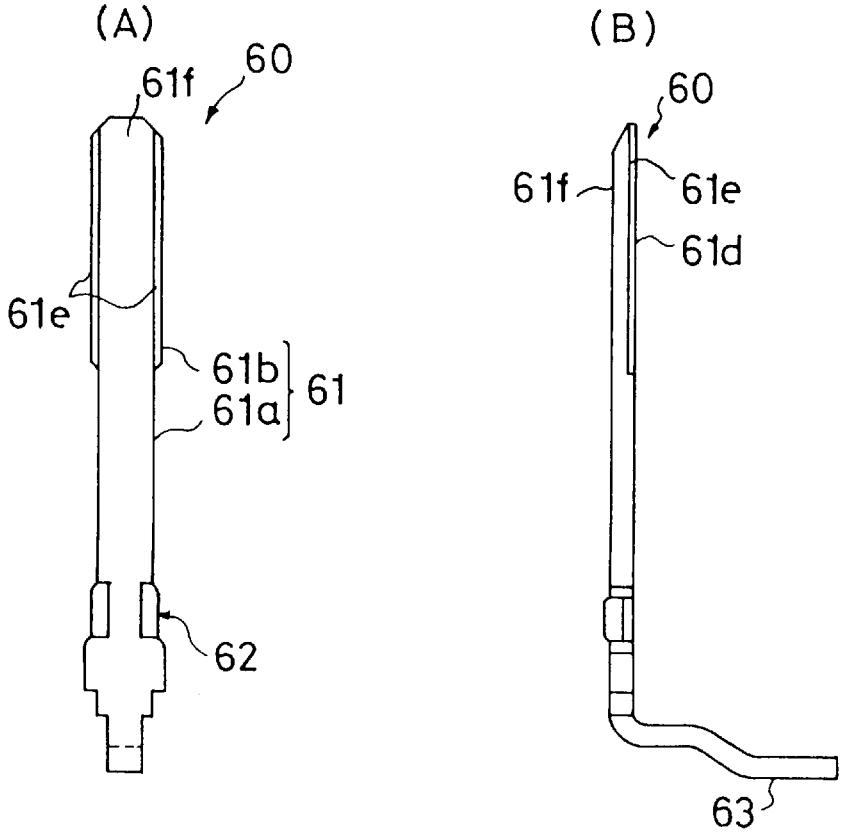
FIG. 9A shows a front view of a plug contact.
FIG. 9B shows a side view of the plug contact.
Figure 10:
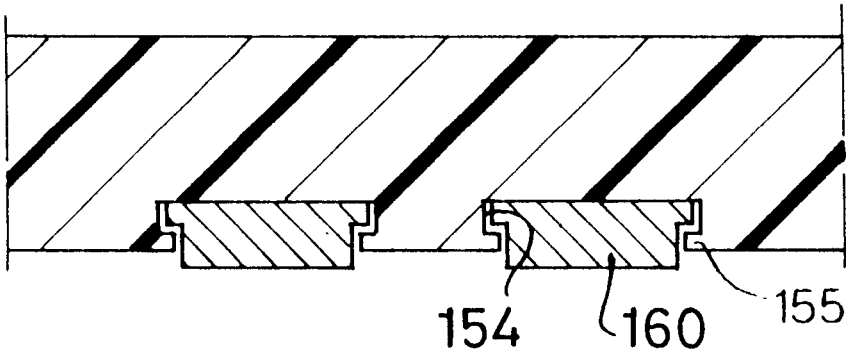
Fig. 10 PRIOR ART
FIG. 10 is a sectional view of contacts and contact-retaining grooves of a connector which is designed as an example to solve problems concerning connectors of prior art.
Figure 11:
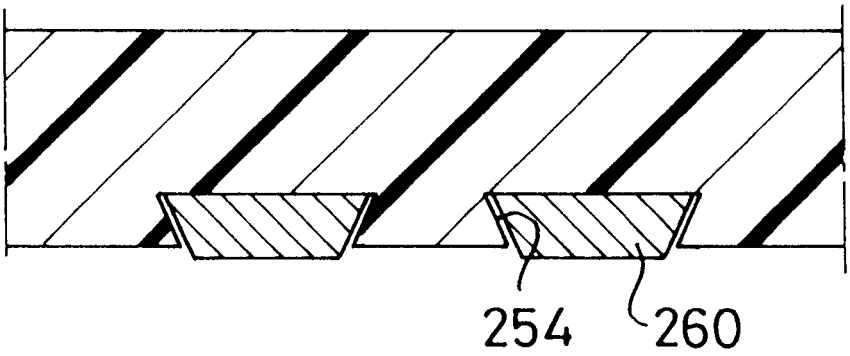
Fig. 11 PRIOR ART
FIG. 11 is a sectional view of contacts and contact-retaining grooves of a connector which is designed as another example to solve problems concerning connectors of prior art.

As shown in FIG. 9, each receptacle contact 60 has a contact portion 61, which is to be guided by a corresponding contact-retaining groove 54, extending into the receptacle cavity 53; an anchoring portion 62, which is to be staked into and retained in a corresponding aperture 55; and a lead portion 63, which extends horizontally outward from the anchoring portion 62 in an extended Z-like figure. Each receptacle contact 60' has an identical anchoring portion 62 and an identical lead portion 63 to those of the receptacle contact 60, but a different contact portion 61' which is only shorter than the contact portion 61. Both receptacle contacts 60 and 60' are formed of an electrically conductive material.

Figure 6:
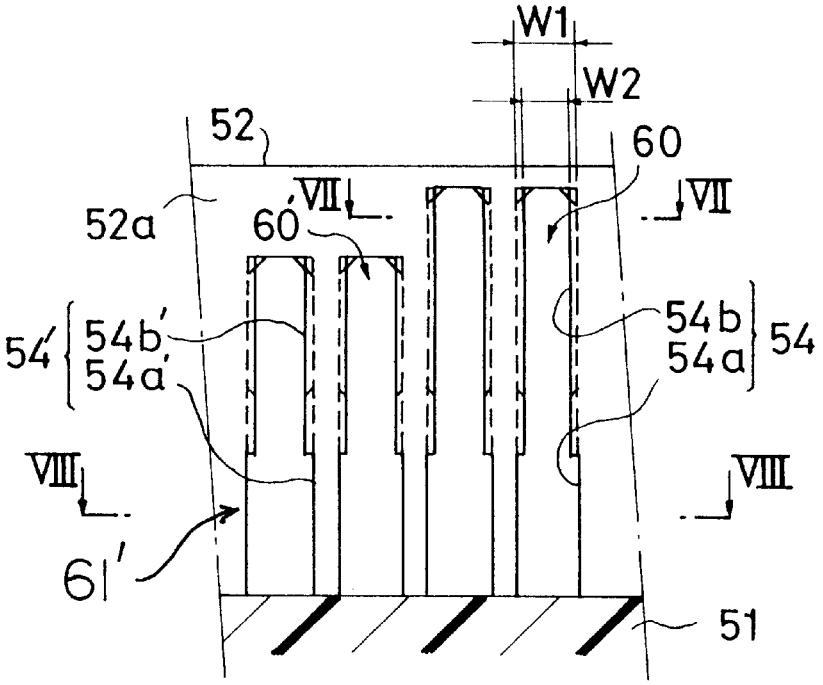
FIG. 6 shows a partially enlarged view of the section indicated by VI in FIG. 5.
Figure 7:
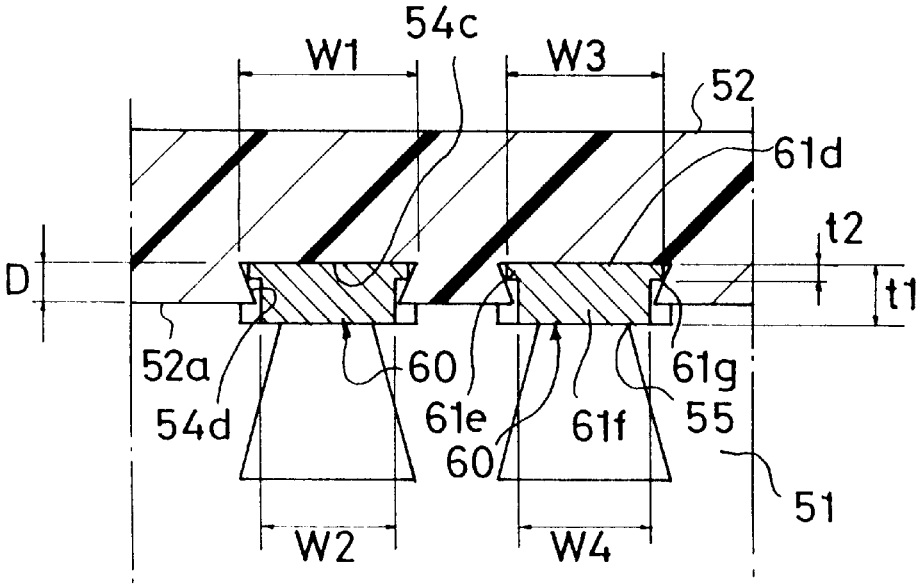
FIG. 7 shows a sectional view of the connector, taken along line VII—VII in FIG. 6.
Figure 8:
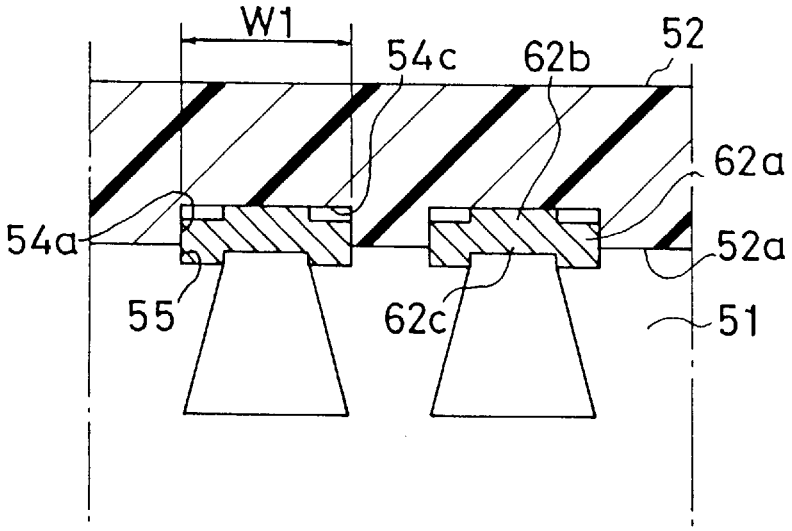
FIG. 8 shows a sectional view of the connector, taken along line VIII—VIII in FIG. 6.

As shown in FIGS. 6, 7 and 8, this receptacle connector 5 has a construction which prevents the contacts 60 and 60' from being accidentally bent or distorted out of the contact-retaining grooves 54 and 54' into the receptacle cavity 53. The contact-retaining grooves 54 and 54' are open into the receptacle cavity 53 on the inside faces 52*a* of the side-wall portion 52. While the lower portions 54*a* and 54*a*' (to the apertures 55) of the contact-retaining grooves 54 and 54' are open with the width W1 of the grooves, the upper portions 54*b* and 54*b*' thereof are open with a width W2 which is tapered down toward the receptacle cavity 53. Therefore, the upper portions of the contact-retaining grooves have a trapezoidal cross section or a dovetail. This width W2 of the opening at the upper portions is smaller than the width W3 of the back portion 61*d* of the contact 60.

In these contact-retaining grooves 54 and 54', the receptacle contacts 60 and 60' are received and retained. As a representative for the contact portions of the receptacle contacts, a following description is given of the contact portion 61 of a receptacle contact 60 retained in a respective contact-retaining groove 54. While the lower portion 61*a* of the contact portion 61 has a simple rectangular cross section, the upper portion 61*b* has a cross section similar to a fattened "T", in which a back portion 61*d* protrudes in the width direction of the contact portion as shown in FIG. 7. Thus, the width (W3) of a back face of the contact is greater than the width (W4) of a front face thereof. The back portion 61*d* faces the bottom 54*c* of the contact-retaining groove 54 when the contact portion is staked into and retained in the contact-retaining groove. Each of these lateral protrusions 61*e* has a thickness t2 which is smaller than the thickness t1 of the main section 61*f*, and these protrusions are formed by plastically deforming the lateral edges of the main section 61*f* in a press work which is rendered against the front side of the contact portion. Thus, a "T"-like cross section is formed by press working both edges of a front portion of the contact.

As the receptacle contacts 60 and 60' are formed by stamping a sheet of metal, the press work necessary for producing the protrusions 61*e* can be carried out simultaneously when the contours of the receptacle contacts 60 and 60' are stamped out of a sheet, or separately after the stamping. Furthermore, although the protrusions 61*e* are provided only to the upper portion (or the upper end portion) of the contact portion 61 in the above receptacle contact 60 or 60', such protrusions may be provided to the entire contact portion 61.

As shown in FIG. 8, the anchoring portion 62 includes a protrusion 62*b* which extrudes from the main portion 62*a* and a recess 62*c* which is provided on the side opposite the protrusion 62*b*. In this design, each anchoring portion 62 acquires resiliency and thereby improved retainability because the protrusion 62*b* faces the bottom 54*c* of the respective contact-retaining groove 54 when the anchoring portion 62 is staked into the respective contact-retaining slot comprising the respective aperture 55 and the lower portion 54*a* of the respective contact-retaining groove 54.

Each of the receptacle contacts 60, constructed as described above, is staked into a respective contact-retaining groove 54 from the bottom of the receptacle housing 50 while the back portion 61*d* of the contact portion is being kept in contact with the bottom 54*c* of the contact-retaining groove. The depth D of the contact-retaining groove 54 is smaller than the thickness t1 of the contact portion 61, and the width W2 of the tapered down opening of the contact-retaining groove 54 is a little greater than the width W4 of the front of the main section 61*f* of the contact portion 61. Therefore, after the insertion when the contact portion 61 is kept in the position, the front of the main section 61*f* protrudes above the inside faces 52*a* of the side-wall portion 52 into the receptacle cavity 53.

In this condition, the receptacle contacts 60 and 60' are retained in the contact-retaining grooves 54 with the front edges 61*g* of the protrusions 61*e* of the contact portions 61 of the receptacle contacts 60 and 60' abutting the tapered faces 54*d* of the contact-retaining grooves 54. Therefore, the receptacle contacts 60 and 60' are securely retained in the receptacle housing 50 not only by the anchoring portions 62 but also by the upper portions of the contact portions 61. This retention by the contact portions 61 is effected by the resiliency gained from the deformation of the protrusions 61*e*. Because the thickness t2 of the protrusions 61*e* is made smaller than the thickness t1 of the main section 61*f* for the purpose of ease of deformation, the press fitting of the receptacle contacts 60 and 60' are carried out smoothly and securely with a relatively small force.

The receptacle connector 5 with these receptacle contacts 60 and 60' is then placed on a circuit board K5 so that the lower ends of the lead portions 63 of the receptacle contacts 60 and 60' are soldered respectively to the circuit board K5. Also, the receptacle connector 5 is fixed on the circuit board K5 with screws through fixing plates 80 which are provided at the longitudinal ends of the receptacle housing 50.

When the plug connector 1 is mated with the receptacle connector 5, the plug contacts 20 are pressed onto the receptacle contacts 60. In this instance, the receptacle contacts 60 are not displaced by the resiliency of the plug contacts 20 because the back portions 61*d* of the receptacle contacts 60 are in contact with the bottoms 54*c* of the contact-retaining grooves 54. Thus, electrical connection is firmly established.

Furthermore, while the plug connector 1 is removed from the receptacle connector 5, even if an external force should act accidentally on any or all of the receptacle contacts 60 in the direction of the receptacle cavity 53, none of the receptacle contacts 60 will bend to escape out of the contact-retaining grooves 54 because the front edges 61*g* of the protrusions 61*e* of the contact portions 61 are engaged with the tapered faces 54*d* of the contact-retaining grooves 54. Because this engagement is made at the upper portions of the receptacle contacts 60, such accident will never happen to make any obstacle to the insertion of the plug connector 1.

Because the means of protection against accidental bending of the contacts 60 and 60' is provided at both sides of each contact portion 61 or 61', even if the receptacle contacts 60' are made shorter than the receptacle contacts 60 to achieve a sequential connection of the contacts, the receptacle contacts 60 and 60' are retained securely in the contact-retaining grooves 54 and 54' notwithstanding the variability in length of these contacts.

The invention being thus described, it will be obvious that the same may be varied in many ways. Such variations are not to be regarded as a departure from the spirit and scope invention, and all such modifications as would be obvious to one skilled in the art are intended to be included within the scope of the following claims.

What is claimed is:

1. An electrical connector comprising:

a contact-retaining portion for retaining a contact in an insulative housing, said contact extending in an engagement direction with a matable connector, and a contact-retaining groove for retaining said contact on a lateral face of said contact-retaining portion, said contact-retaining groove extending in said engagement direction; said connector, upon engagement with said matable connector, electrically connecting said contact with a matable contact which is provided in said is matable connector;

wherein:

said contact has at least at a tip portion a "T"-like cross section in a plane perpendicular to said engagement direction, and in said "T"-like cross section, a width of a back face of said contact formed by a cross part of said "T"-like cross section is greater than the width of a front face thereof;

said contact-retaining groove has a trapezoidal cross section in a plane perpendicular to said engagement direction, and in said trapezoidal cross section, the width of a bottom of said contact-retaining groove is greater than the width of an opening thereof on said lateral face of said contact-retaining portion;

the width of said opening is smaller than the width of the back face of said contact;

when said contact is received and retained in said contact-retaining groove, at least a back portion of said contact is retained inside said contact-retaining groove, said cross part of said "T"-like cross section having opposite free ends formed with corners engaging adjacent sidewalls of the groove;

the width of said front face of said contact is smaller than the width of said opening of said contact-retaining groove, and a thickness of said contact is greater than a depth of said contact-retaining groove; and when said contact is received and retained in said contact-retaining groove, said front face of said contact protrudes above said lateral face of said contact-retaining portion.

2. The electrical connector set forth in claim 1 wherein said back portion of said contact is press fitted into said contact-retaining groove so that said contact is retained in said contact-retaining groove.

3. The electrical connector set forth in claim 1 wherein said "T"-like cross section is formed by press working both edges of a front portion of said contact.

4. The electrical connector set forth in claim 3 wherein said back portion of said contact is press fitted into said contact-retaining groove so that said contact is retained in said contact-retaining groove.

5. The electrical connector set forth in claim 1 wherein the back face of the contact engages a bottom wall of the groove throughout an entire length of said contact where said front face of said contact protrudes above said lateral face of said contact-retaining portion.

6. The electrical connector set forth in claim 1 wherein the back face of the contact engages a bottom wall of the groove throughout an entire length of said contact where said leading end portion protrudes out of the mouth.

7. An electrical connector matable with a complementary electrical connector by relative movement together of respective mating faces thereof in a mating direction comprising:

an insulating housing including a contact-retaining portion having a lateral face extending towards the mating face and formed with a series of contact-retaining grooves which extend in said mating direction toward the mating face and have respective mouths opening on said lateral face;

a series of contacts retained in respective of said contact-retaining grooves so as to extend toward said mating face and having respective leading end portions adjacent the mating face so that the contacts can be brought, leading end portions first, into electrically connecting engagement with respectively contacts of the complementary connector during mating movement;

wherein:

each leading end portion has a front face and a back face and is of "T"-shape cross-section in a plane perpendicular to said mating direction so that the back face which is formed by a cross-limb of said "T"-like cross section has a width greater than a width of the front face; and, each contact-retaining groove has a leading end retaining portion of trapezoidal cross-section in a plane perpendicular to said mating direction with the mouth having a width less than a width of a bottom, opposite the mouth, and less than the width of the back face of the leading end portion retained therein so that at least the back face of the leading end portion is retained inside said leading end retaining portion of the contact-retaining groove, said cross part of said "T"-like cross section having opposite free ends formed with corners engaging adjacent sidewalls of the groove;

the width of said front face of said leading end portion is less than the width of the mouth and the contact has a thickness, measured between front and back faces, which is greater than a depth of said contact-retaining groove, measured between the bottom and the mouth; so that said front face of said leading end portion of said contact protrudes out of the mouth of the contact-retaining groove exposed for electrically connecting engagement with a contact of the complementary connector.

8. The electrical connector set forth in claim 7 wherein the leading end portions of respective contacts are retained as respective press fits in respective leading end retaining portions of respective contact retaining grooves.

9. The electrical connector set forth in claim 8 wherein said "T"-shape cross-section is formed by stamping opposite edge portions of the front face of the leading end portion of each contact.

* * * * *